US007192314B1

(12) United States Patent
Shiu

(10) Patent No.: US 7,192,314 B1
(45) Date of Patent: Mar. 20, 2007

(54) POWER CONNECTOR ASSEMBLY DEVICE

(75) Inventor: Kuang-Hua Shiu, Jhongli (TW)

(73) Assignee: Singatron Enterprise Co., Ltd., Hsinchu (TW)

( * ) Notice: Subject to any disclaimer, the term of this patent is extended or adjusted under 35 U.S.C. 154(b) by 0 days.

(21) Appl. No.: 11/404,088

(22) Filed: Apr. 14, 2006

(51) Int. Cl.
*H01R 24/04* (2006.01)

(52) U.S. Cl. ..... 439/669

(58) Field of Classification Search ..... 439/669, 439/668, 79, 572, 571
See application file for complete search history.

(56) References Cited

U.S. PATENT DOCUMENTS 3,969,011 A * 7/1976 Yamada ..... 439/569
6,086,418 A * 7/2000 Chang ..... 439/573
6,695,644 B2 * 2/2004 Zhao et al. ..... 439/580
2004/0242065 A1 * 12/2004 Takahashi ..... 439/573

* cited by examiner

*Primary Examiner*—Phuong Dinh
(74) *Attorney, Agent, or Firm*—Troxell Law Office PLLC

(57) ABSTRACT

A power connector assembly device includes an insulator, a containing chamber corresponding to a power plug, a containing hole corresponding to a power terminal, containing slots for placing conductive terminals, and a latching slot being latched with a fixing side plate having a screw member. The latching slot of insulator is provided with a slideway corresponding to a track of the fixing side plate, wherein the fixing side plate is installed with a screw hole and a fixing slot. The screw hole is corresponding to a screw part of the screw member and the fixing slot is corresponding to a fixing part of the screw member. Accordingly, when the screw member and the fixing side plate are attached to the insulator, the power connector corresponding to the power plug can be firmly assembled by fixing the track of fixing side plate into the slideway of latching slot.

9 Claims, 8 Drawing Sheets

POWER CONNECTOR ASSEMBLY DEVICE

BACKGROUND OF THE INVENTION (a) Field of the Invention

The present invention relates to a power connector assembly device, and more particularly to a power connector assembly device which can be firmly assembled by fixing a track of fixing side plate into a slideway.

(b) Description of the Prior Art

Referring to FIG. 1 and FIG. 2, a front end of an insulator A1 of a conventional power connector A, and a rear end of the insulator A2 are provided with containing chambers A2 which are installed with a plurality of conductive terminals A3. A side end of the insulator A1 is provided with a clipping plate A4 which is installed with a screw member A5, wherein the screw member A5 is used to fix the power connector A to the circuit board A7 via a screw A8. However, when the clipping plate A4 and the screw member A5 are affixed to the insulator A1 of power connector A, they are easy to be fallen off, and when the power connector A is connected to a power plug A6, it is also easy to cause an ill contact to the power plug A6 by the screw member A5 of clipping plate A4.

Accordingly, how to eliminate the aforementioned drawbacks is a technical issue which needs to be solved by the inventor.

SUMMARY OF THE INVENTION

The present invention is to provide a power connector assembly device, wherein a latching slot of an insulator is provided with a slideway which is corresponding to a track of a fixing side plate having a screw hole and a fixing slot, and the screw hole and the fixing slot of the fixing side plate are also corresponding to a screw part and a fixing part of a screw member, such that the screw member and the fixing side plate are affixed to the insulator by fixing the track of fixing side plate into the slideway, thereby firmly assembling the power connector.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
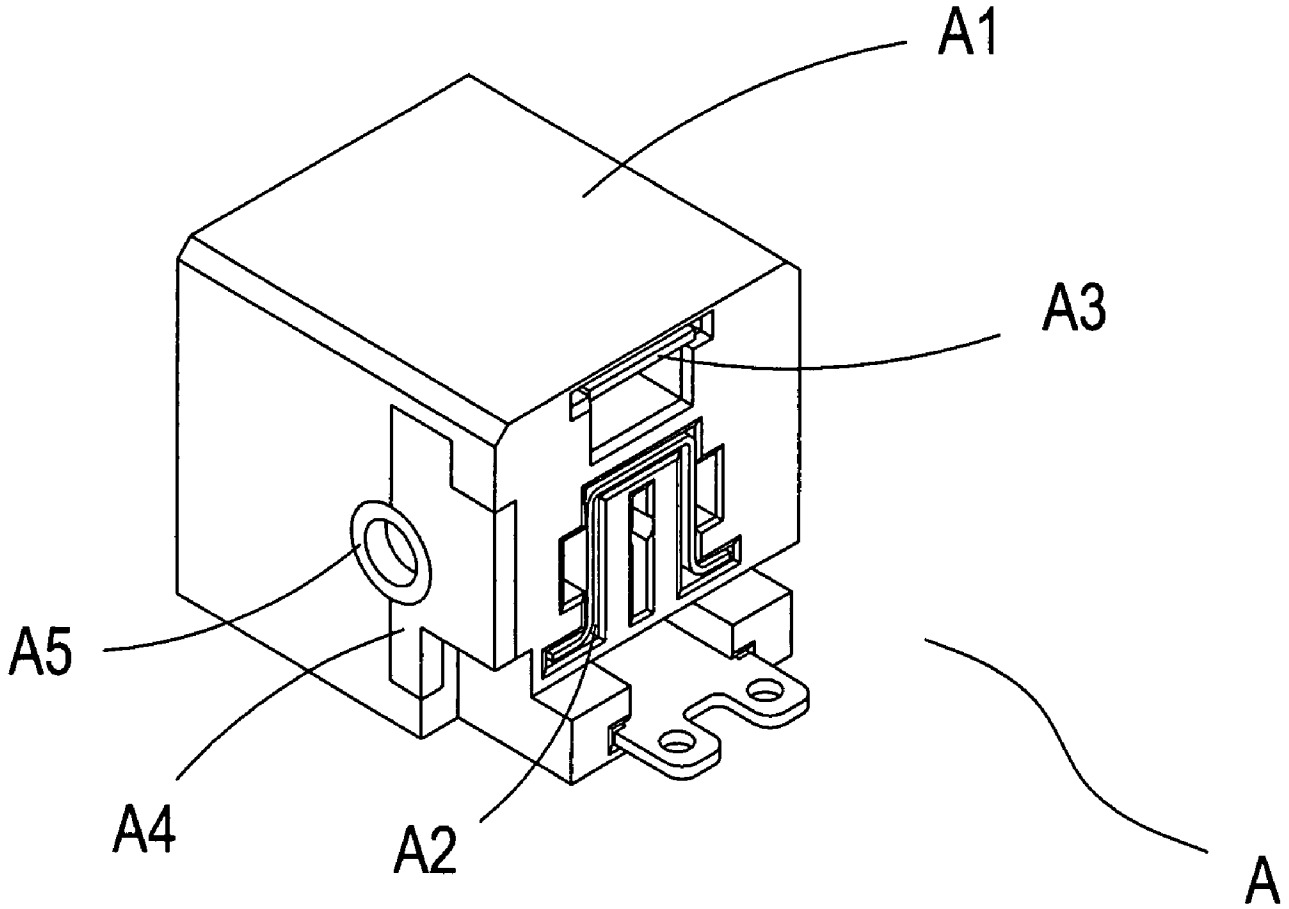
FIG. 1 Prior Art
FIG. 1 shows a perspective view of a conventional device.
Figure 2:
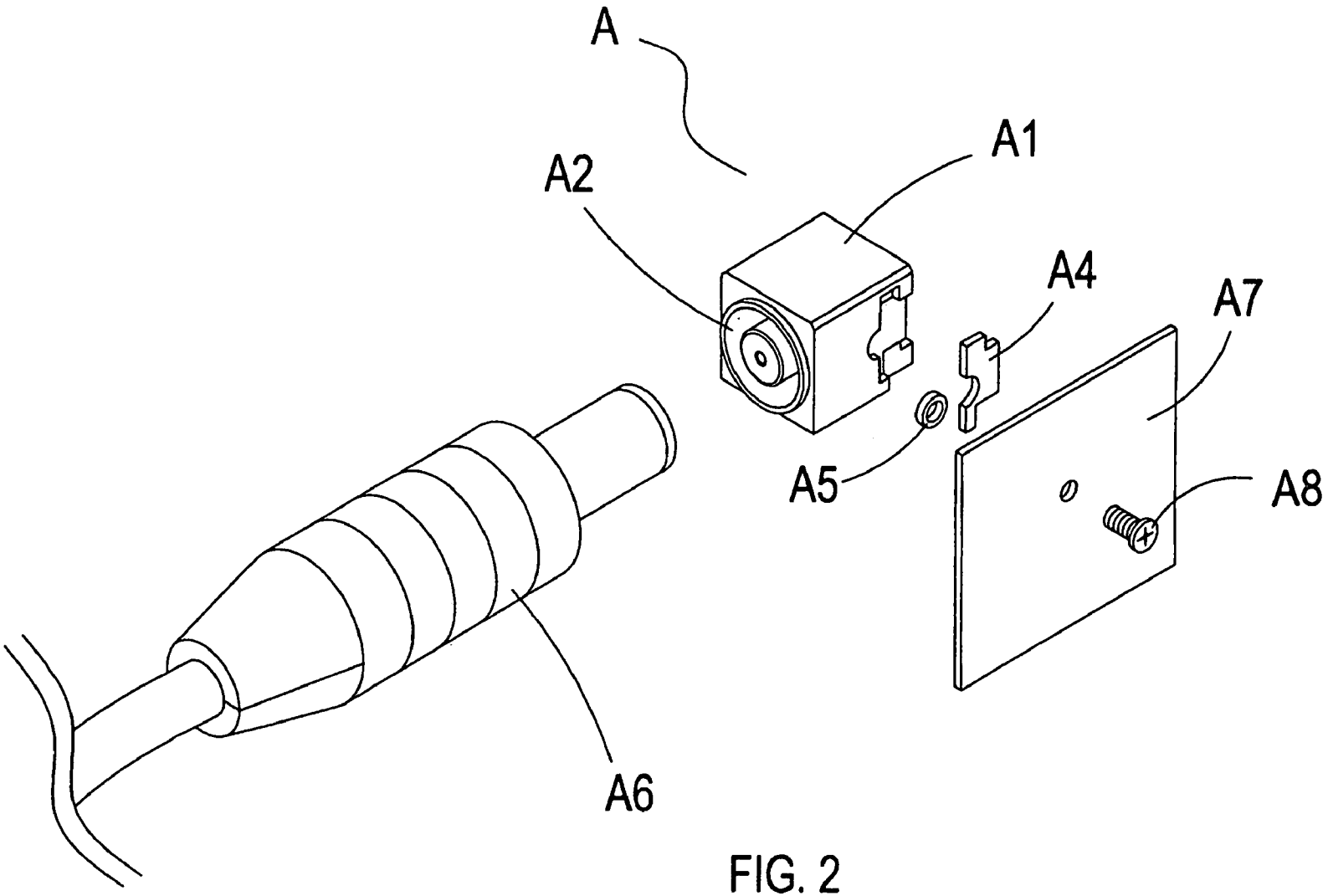
FIG. 2 Prior Art
FIG. 2 shows an exploded view of a conventional device.
Figure 3:
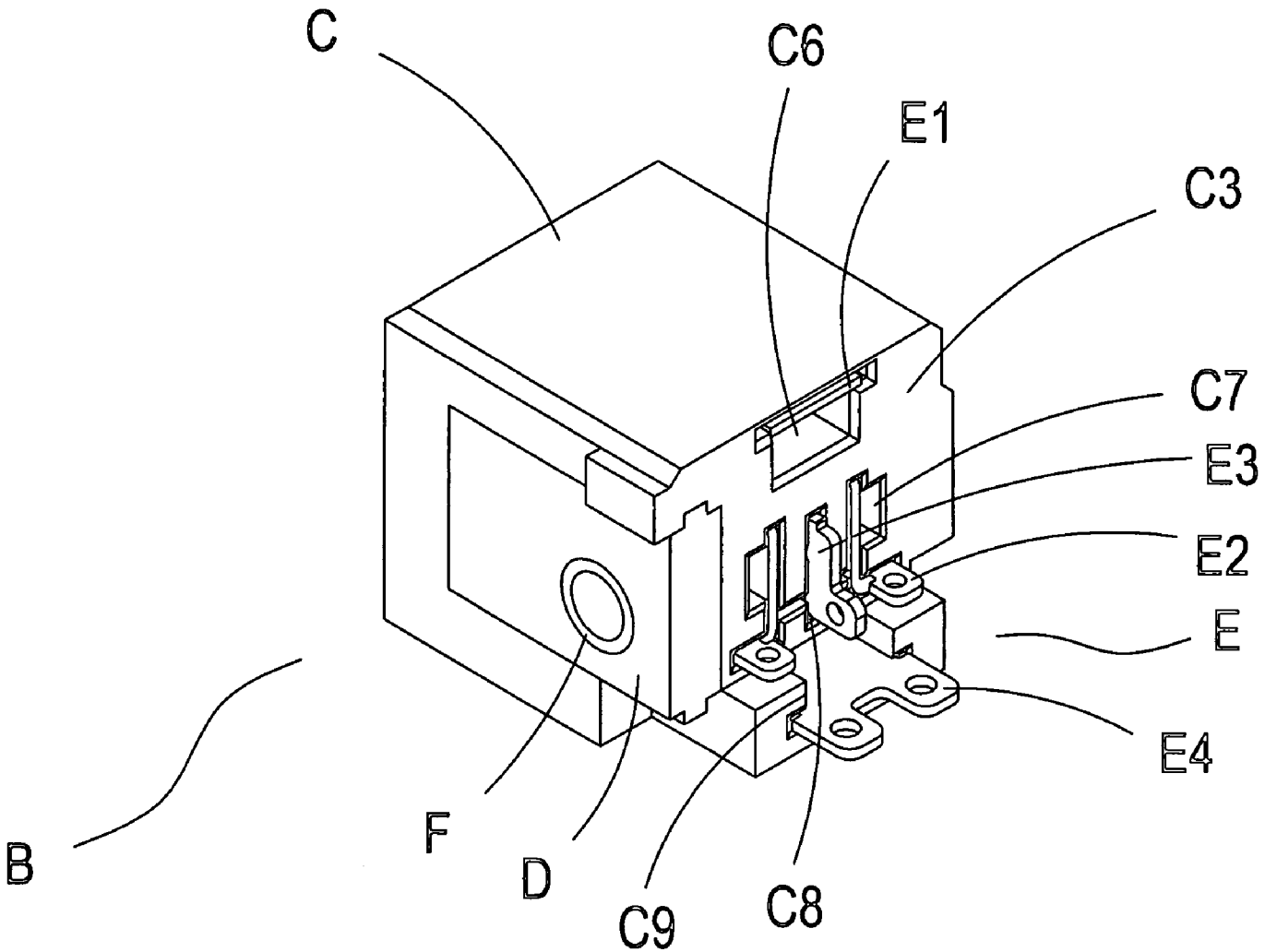
FIG. 3 shows a perspective view of the present invention.
Figure 4:
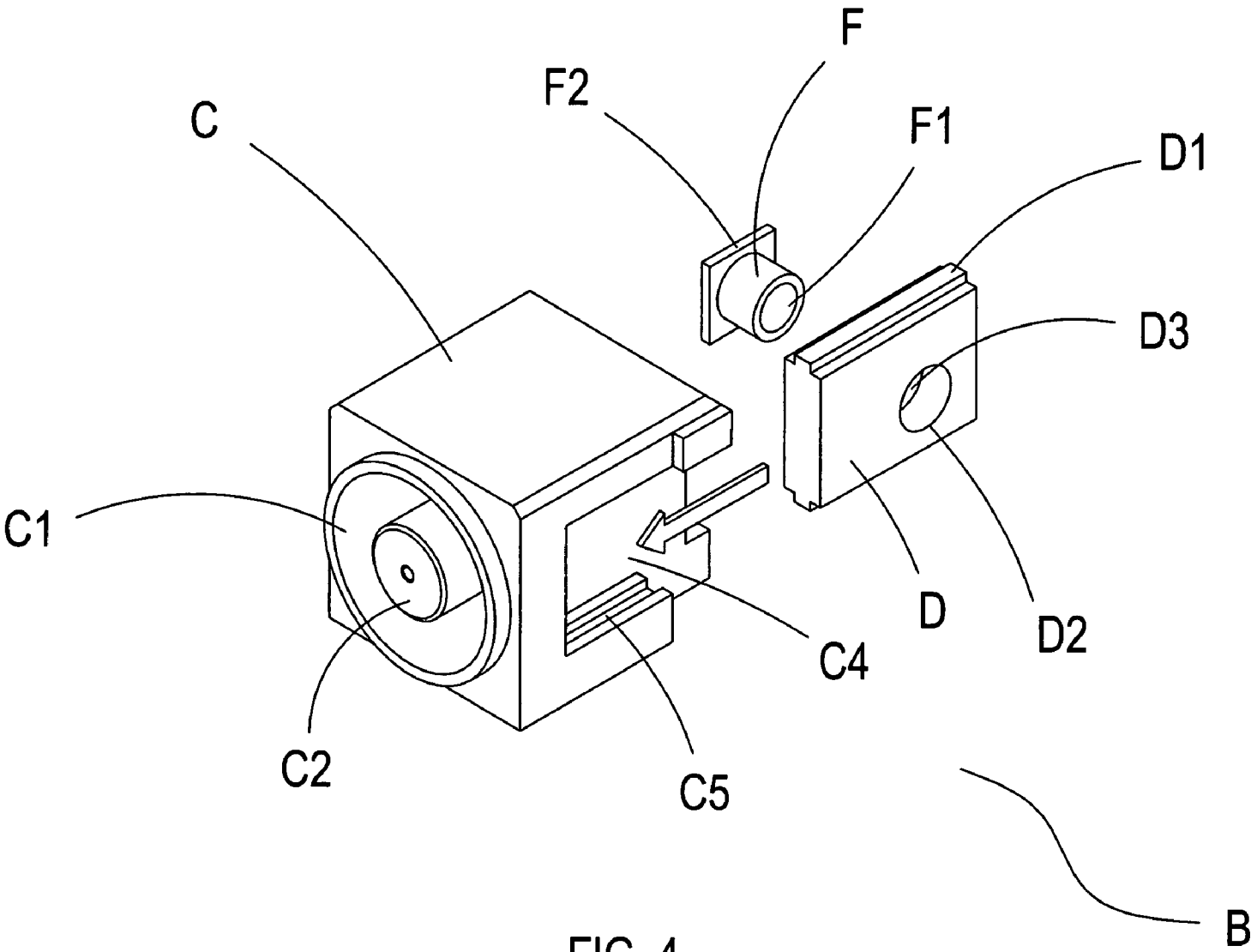
FIG. 4 shows an exploded view of the present invention.
Figure 5:
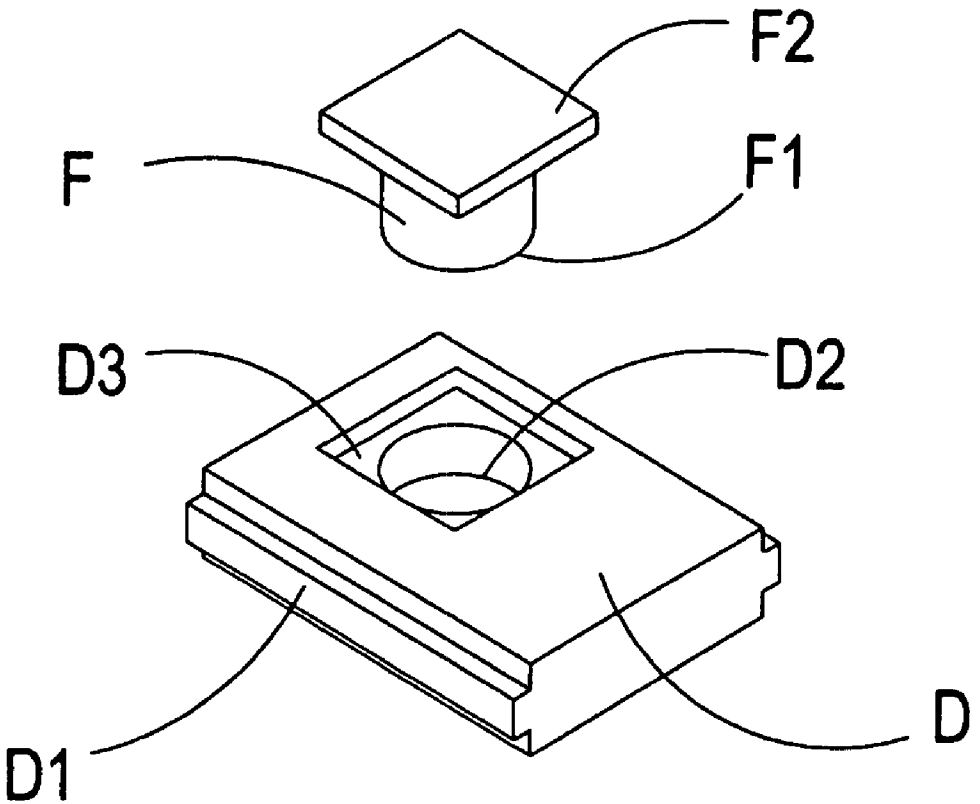
FIG. 5 shows a partial exploded view of the present invention.
Figure 6:
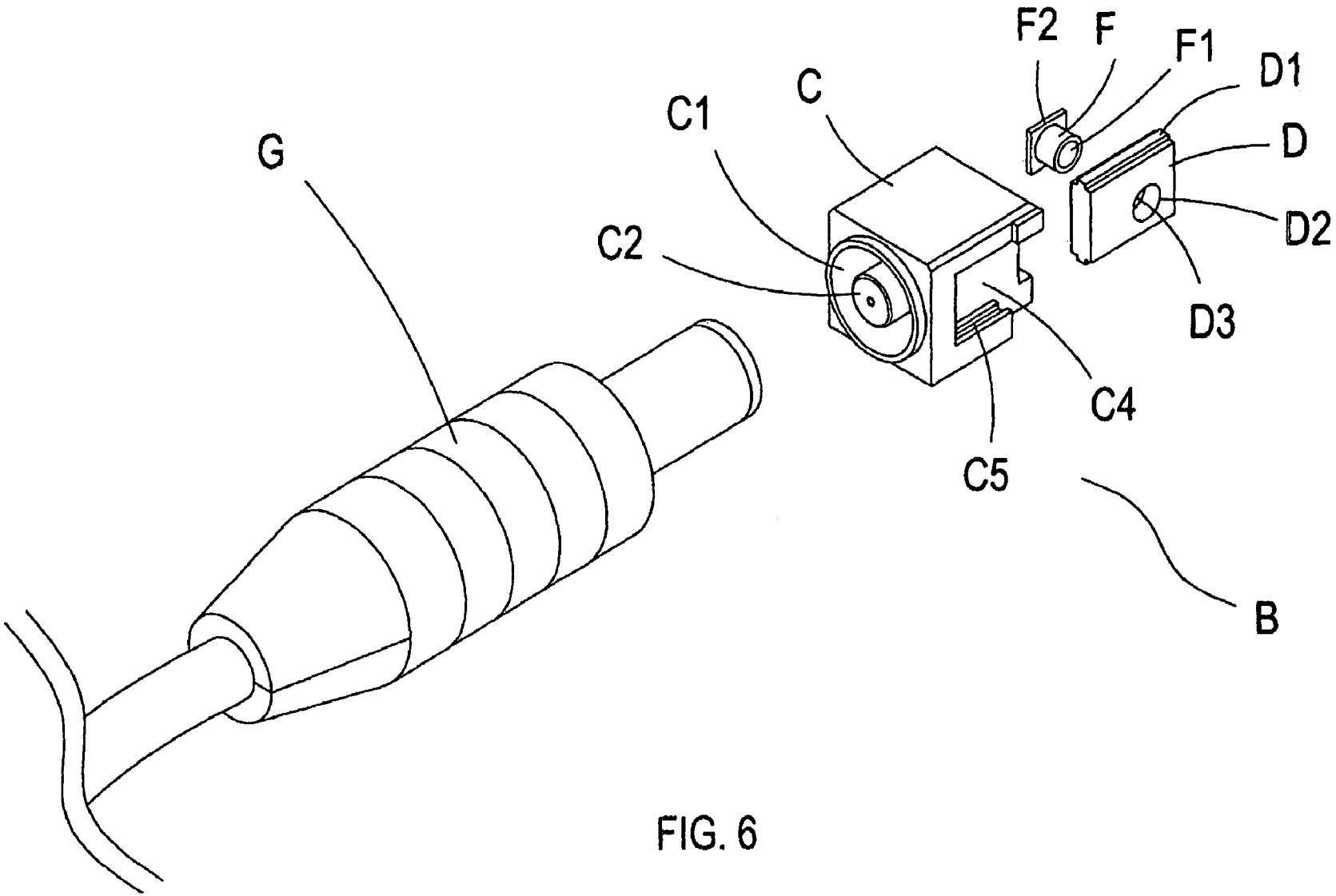
FIG. 6 shows a schematic view of an embodiment of the present invention.
Figure 7:
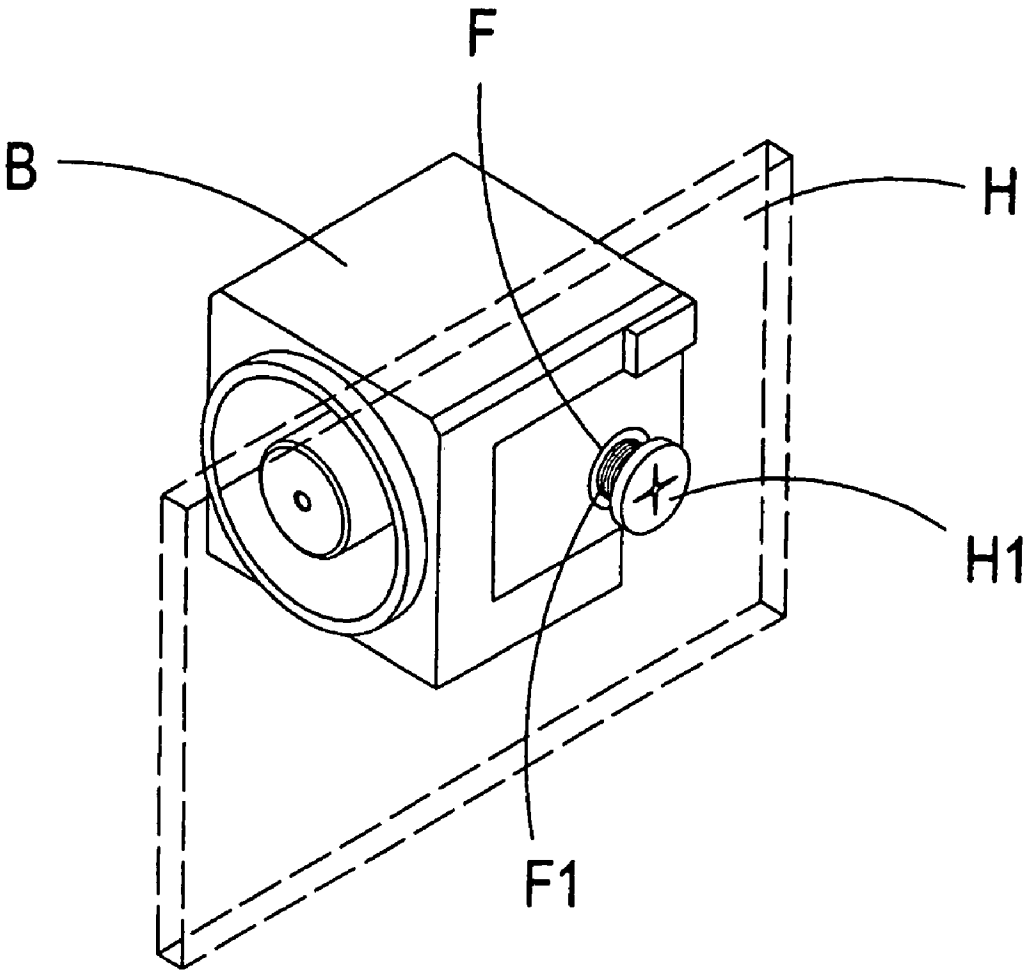
FIG. 7 shows a schematic view of another embodiment of the present invention.
Figure 8:
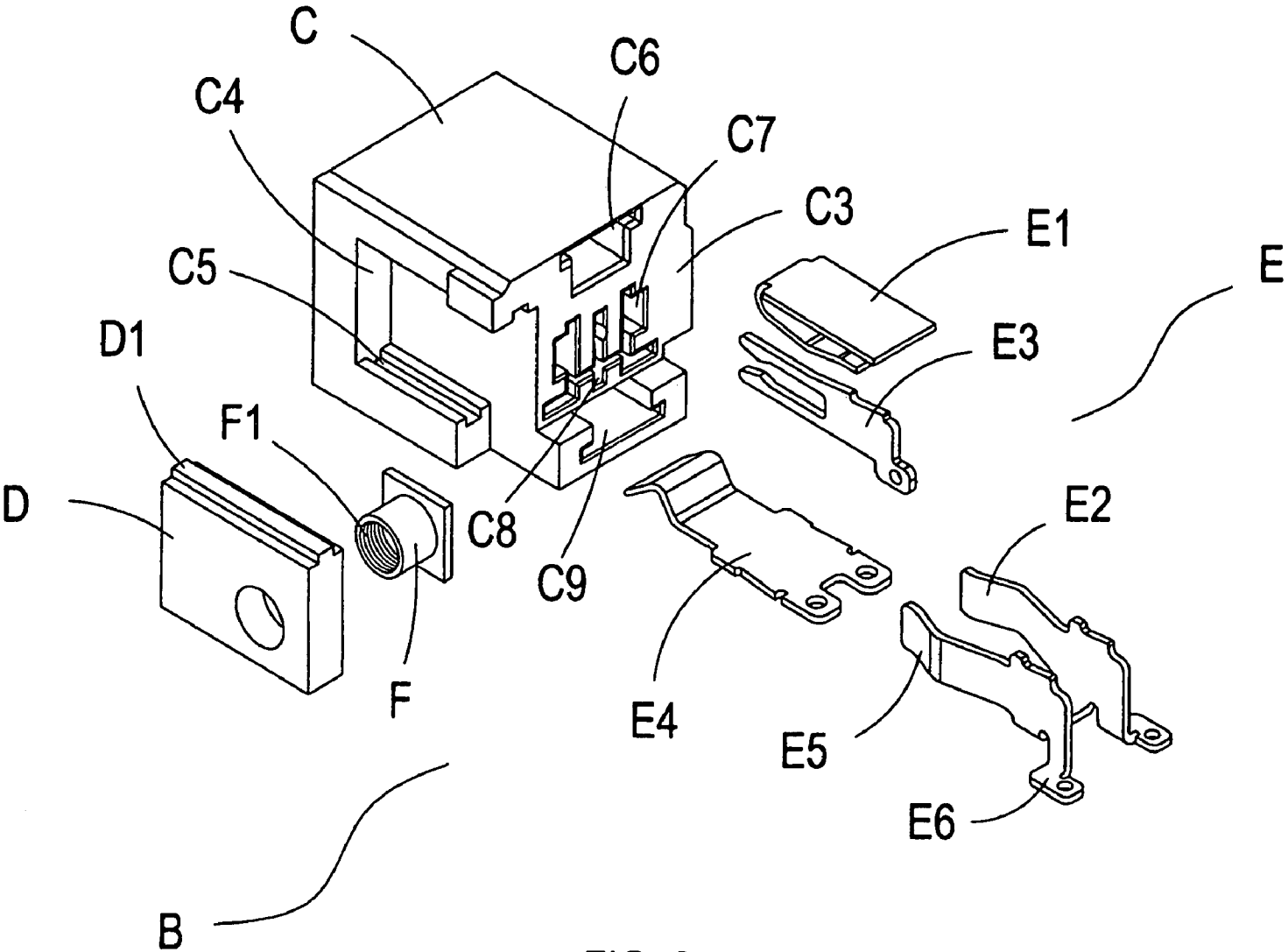
FIG. 8 shows a schematic view of a further embodiment of the present invention.

Referring to FIG. 3, FIG. 4, and FIG. 5, the present invention is to provide a power connector assembly device which includes a power connector B, an insulator C, a fixing side plate D, and conductive terminals E.

A front end of the insulator C is formed with a containing chamber C1 and a containing hole C2, a rear end of the insulator C is formed with containing slots C3, and a side end of the insulator C is formed with a latching slot C4 which is latched with the fixing side plate D being provided with a screw member F.

The latching slot C4 of insulator C is provided with a slideway C5 which is corresponding to a track D1 of the fixing side plate D, and the fixing side plate D is also provided with a screw hole D2 and a fixing slot D3 which is corresponding to the screw member F, wherein the screw hole D2 and the fixing slot D3 of the fixing side plate D are corresponding to a screw part F1 and a fixing part F2 of the screw member F. The containing slots C3 of power connector B further include a first containing slot C6, a second containing slot C7, a third containing slot C8, a fourth containing slot C9, and a plurality of related containing slots C3 for emplacing the conductive terminals E, whereas the conductive terminals E of power connector B further include a first terminal E1, a second terminal E2, a third terminal E3, a clipping terminal E4, and a plurality of related terminals E3 which can be emplaced in the containing slots C3.

Accordingly, the fixing side plate D and the screw member F of the power connector B are affixed to the insulator C, by fixing the track D1 of fixing side plate D into the slideway C5 of latching slot C4 of insulator C, so as to firmly assemble the power connector B.

Referring to FIG. 5, FIG. 6, FIG. 7, and FIG. 8, the front end of insulator C is provided with the containing chamber C1 and the containing hole C2, the rear end of insulator C is provided with the containing slots C3, and the side end of insulator C is provided with the latching slot C4 which is extended to form the slideway C5, wherein the fixing side plate D is installed with the screw hole D2 and the fixing slot D3 which is corresponding to the screw member, and the side end of fixing side plate D is extended to form the track D1.

The screw member F is provided with the screw part F1 and the fixing part F2 which are corresponding to the screw hole D2 and the fixing slot D3 of the fixing side plate D. When the latching slot C4 at the side end of insulator C is affixed to the fixing side plate D of power connector B, the insulator C and the fixing side plate D can be assembled together through the slideway C5 extended from the latching slot C4 and the track D1 extended from the fixing side plate D.

The slideway C5 of latching slot C4 can be further a projected slideway, a concaved slideway, a projected and concaved slideway, and one or more than one related fixed slideway which is correspondingly assembled with the fixing side plate D. In addition, the track D1 of fixing side plate D can be further a projected track, a concaved track, a projected and concaved track, and one or more than one related fixed track which is correspondingly assembled with the slideway C5.

The containing slots C3 of power connector B further includes the first containing slot C6, the second containing slot C7, the third containing slot C8, the fourth containing slot C9, and the plurality of related containing slots C3 for emplacing the conductive terminals E; whereas the conductive terminals E of power connector B further includes the first terminal E1, the second terminal E2, the third terminal E3, the clipping terminal E4, and the plurality of related conductive terminals E which can be emplaced in the containing slots C3. Furthermore, the conductive terminals E further include a projection part E5 which is protruded from the containing slot C3 and can be contacted with a power plug G, and a welding part E6 which is protruded from an exterior of the insulator C and can be provided for a welding. The screw member H1 is penetrated through the circuit board H and has the power connector B screw-fastened on the circuit board H by the screw part F1 of the screw member F, so as to effectively conduct electricity to the power plug G.

To further manifest the advancement and practicability of the present invention, the present invention is compared with a conventional device:

Shortcomings of a conventional application

1. The clipping side plate and the screw member, which are assembled with the insulator, are easy to be fallen off.
2. It is easy to cause an ill contact when the power connector is attached to the power plug.

Advantages of the present invention

1. Through the slideway of latching slot at the side end of insulator, and the track which is extended from the fixing side plate, the power connector can be firmly assembled.
2. According to item 1, when the fixing side plate is assembled with the insulator, and the screw member is correspondingly assembled with a circuit board, they will not be easy to be fallen off nor will they be weakly assembled.
3. According to item 1, when the power connector is attached to the power plug, power connector will not be easily loosened, nor will the power plug be ill contacted.
4. It is provided with advancement and practicability.
5. It can improve an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A power connector assembly device comprising a power connector which is corresponding to a power plug, an insulator, a fixing side plate, and conductive terminals, wherein a front end of the insulator is provided with a containing chamber corresponding to the power plug, and a containing hole corresponding to a power terminal, a rear end of the insulator is provided with containing slots for emplacing the conductive terminals, and a side end of the insulator is provided with a latching slot which is latched with a fixing side plate being installed with a screw member; the latching slot of insulator being provided with a slideway which is corresponding to a track of the fixing side plate; the fixing side plate being provided with a screw hole and a fixing slot, with the screw hole being corresponding to a screw part of the screw member and the fixing slot being corresponding to a fixing part of the screw member; when the screw member and the fixing side plate being affixed to the insulator, the power connector which is corresponding to the power plug can be firmly assembled by fixing the track of fixing side plate into the slideway of latching slot.

2. The power connector assembly device according to claim 1, wherein the slideway of latching slot can be further a projected slideway, a concaved slideway, a projected and concaved slideway, and one or more than one related fixed slideway which is correspondingly assembled with the fixing side plate.

3. The power connector assembly device according to claim 1, wherein the track of fixing side plate can be further a projected track, a concaved track, a projected and concaved track, and one or more than one related fixed track which is correspondingly assembled with the slideway.

4. The power connector assembly device according to claim 1, wherein the containing slots further include a first containing slot, a second containing slot, a third containing slot, a fourth containing slot, and a plurality of related containing slots which can emplace the conductive terminals.

5. The power connector assembly device according to claim 1 or claim 4, wherein the conductive terminals further include a first terminal, a second terminal, a third terminal, a clipping terminal, and a plurality of related conductive terminals which can be emplaced in the containing slots.

6. The power connector assembly device according to claim 4, wherein the conductive terminals further include a first terminal, a second terminal, a third terminal, a clipping terminal, and a plurality of related conductive terminals which can be emplaced in the containing slots.

7. The power connector assembly device according to claim 1 or claim 5, wherein the conductive terminals further include a projection part which is protruded from the containing slot and can be in contact with the power plug, and a welding part which is protruded from an exterior of the insulator an can be provided for a welding.

8. The power connector assembly device according to claim 5, wherein the conductive terminals further include a projection part which is protruded from the containing slot and can be in contact with the power plug, and a welding part which is protruded from an exterior of the insulator an can be provided for a welding.

9. The power connector assembly device according to claim 6, wherein the conductive terminals further include a projection part which is protruded from the containing slot and can be in contact with the power plug, and a welding part which is protruded from an exterior of the insulator an can be provided for a welding.

* * * * *